US006970136B2

(12) United States Patent
Sekine et al.

(10) Patent No.: US 6,970,136 B2
(45) Date of Patent: Nov. 29, 2005

(54) ANTENNA APPARATUS

(75) Inventors: Shuichi Sekine, Yokohama (JP); Hiroshi Watanabe, Hachioji (JP); Motoji Noda, Sagamihara (JP); Noriaki Odachi, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/661,594

(22) Filed: Sep. 15, 2003

(65) Prior Publication Data

US 2004/0061651 A1 Apr. 1, 2004

Related U.S. Application Data

(62) Division of application No. 09/961,324, filed on Sep. 25, 2001, now Pat. No. 6,661,382.

(30) Foreign Application Priority Data

Sep. 28, 2000 (JP) ..... 2000-296964

(51) Int. Cl.[7] ..... H01Q 1/24
(52) U.S. Cl. ..... 343/702; 343/825; 343/862
(58) Field of Search ..... 343/702, 825, 343/828, 830, 831, 846, 850, 860, 862

(56) References Cited

U.S. PATENT DOCUMENTS

| | | | | |
|---|---|---|---|---|
| 3,474,453 | A | 10/1969 | Ireland | 343/745 |
| 5,926,140 | A | 7/1999 | Yokoyama | 343/702 |
| 5,969,684 | A | 10/1999 | Oh et al. | 343/702 |
| 5,969,688 | A | 10/1999 | Ireland | 343/749 |
| 6,087,994 | A | 7/2000 | Lechter | 343/702 |
| 6,130,651 | A | 10/2000 | Yanagisawa et al. | 343/895 |
| 6,211,826 | B1 | 4/2001 | Aoki | 343/702 |
| 6,388,626 | B1 | 5/2002 | Gamalielsson et al. | 343/702 |
| 6,661,382 | B2 * | 12/2003 | Sekine et al. | 343/702 |

FOREIGN PATENT DOCUMENTS

| | | |
|---|---|---|
| JP | 2000-101319 | 4/2000 |

* cited by examiner

*Primary Examiner*—Michael C. Wimer
(74) *Attorney, Agent, or Firm*—Oblon, Spivak, McClelland, Maier & Neustadt, P.C.

(57) ABSTRACT

An antenna apparatus coupled to a feeding point arranged on a cavity is disclosed. The apparatus includes a linear element extending from the feeding point and having a physical length that is shorter than a one-quarter wavelength. A half-wave antenna element is connected to an end of the linear element. The apparatus also includes a metal conductor piece including a connecting point between the linear element and the half-wave antenna element and located close to one surface of the cavity. The linear element includes a first portion extending in a first direction opposite to that of the half-wave element from the feeding point and in parallel with one surface of the cavity and a second portion extending in a second direction, which is equal to a direction in which the half-wave antenna element extends, and in parallel with one surface of the cavity.

15 Claims, 7 Drawing Sheets

ANTENNA APPARATUS

CROSS-REFERENCE TO RELATED APPLICATIONS

This application is based upon and claims the benefit of priority from the prior Japanese Patent Application No. 2000-296964, filed Sep. 28, 2000, the entire contents of which are incorporated herein by reference.

BACKGROUND OF THE INVENTION

1. Field of the Invention

The present invention relates to an antenna apparatus of a portable radio terminal having a radio function.

2. Description of the Related Art

In a portable radio terminal including an antenna and a radio that are integrated as one component, the directivity of the antenna is likely to vary with the shape of a cavity.

It is known that the use of a half-wave ($\lambda/2$) antenna reduces current flowing from a feeder line to a cavity. If a half-wave linear antenna is employed, an influence of a cavity is reduced, which is convenient for the design of an antenna system.

Even in the half-wave antenna, however, current is likely to flow into the cavity to make it impossible to form a desired pattern depending on the configuration of a matching circuit.

In most cases, a quarter-wave ($\lambda/4$) element is used as the matching circuit for impedance matching between a half-wave antenna and a load. It is known that the quarter-wave-length element has relatively wider band characteristics than the matching circuit of lumped constant elements does. However, there is a problem that current leaks from a feeder point to a cavity when the quarter-wave-length element is inserted between the half-wave antenna and the feeder point. Such a leakage current causes unnecessary electric wave emitted from the cavity.

Conventionally, when the quarter-wave-length element was used as a matching circuit, its wide-band characteristics were prioritized and a leakage of current to the cavity had to be ignored. In other words, an attempt to optimize the quarter-wave-length element was made to obtain wide-band characteristics, not to reduce a leakage of current to the cavity.

In Japanese Patent Application No. 11-051462, the inventors of the present invention proposes an antenna apparatus in which a connecting point between a half-wave antenna and a quarter-wave-length element serving as a matching circuit is located in a specific space of a cavity to reduce a leakage of current to the cavity.

FIG. 8 is a schematic diagram of the antenna apparatus proposed in the above Japanese Patent Application. Referring to FIG. 6, a connecting point 65 is located close to the side of a cavity 61 and somewhat below a feeding point 62 within a range of the side. This configuration produces the advantage of reducing a leakage of current to the cavity.

However, the antenna apparatus shown in FIG. 8, of which the quarter-wave-length element serving as a matching circuit has to be encased in a plastic cavity of a cellular phone, the quarter-wave-length element becomes relatively long depending on the frequency and thus requires a large area when it is inserted in the cavity of a cellular phone that steadily decreases in size. Further, the wide-band characteristics of the quarter-wave-length element are likely to deteriorate.

BRIEF SUMMARY OF THE INVENTION

An object of the present invention is to provide an antenna apparatus capable of achieving compatibility between a reduction in mounting area and an increase in frequency band of a matching circuit thereof.

Only the physical length of a quarter-wave ($\lambda/4$) element serving as a matching circuit is decreased without changing the electric length thereof. The electric length of the quarter-wave-length element corresponds to a length of $\pi/2$ in which the amplitude of an electromagnetic wave reaches its peak, while the physical length corresponds to the actual length of the quarter-wave-length element measured from the feeder point.

Specifically, an antenna apparatus of the embodiment of the present invention is coupled to a feeding point arranged on a cavity. The antenna apparatus includes a linear element extending from the feeding point and having a physical length that is shorter than a one-quarter wavelength, a half-wave antenna element connected to an end of the linear element, and a metal conductor piece including a connecting point between the linear element and the half-wave antenna element and located close to one side of the cavity.

The linear element whose physical length is shorter than a quarter wavelength includes at least two portions as to an imaginary plane in parallel with one side surface of the cavity. The one is a first portion extending in a first direction opposite to that of the half-wave element from the feeding point. The other is a second portion extending in a second direction, which is equal to a direction in which the half-wave antenna element extends.

The linear element and the half-wave antenna element are connected at their ends. This connecting point may be located bellow the feeding point along in the first direction.

The physical length of the linear element is shorter than a one-quarter wavelength, while the electric length thereof is a one-quarter wavelength. Therefore, the end of the linear element needs to be capacitive.

The metal conductor piece attached to the end of the linear element has only to be thicker than the linear element and is shaped like a cylinder, a sphere, a square pole and the like. The whole or only the surface of the metal conductor piece can be formed of a conductor. This metal conductor piece increases the capacitance of the linear element. The capacitance is in proportion to the cross-sectional area of the conductor and in inverse proportion to the length thereof. The cross-sectional area of the metal conductor piece is therefore larger than that of the linear element. The physical length of the linear element can be shortened by the capacitance corresponding to an increase in cross-sectional area. More specifically, the physical length of the linear element can be reduced to a range from $\lambda/6$ to $\lambda/5$.

The metal conductor piece forms a plurality of current paths between the linear element and the half-wave antenna element. The frequency band of the matching circuit of the antenna apparatus can thus be broadened. Consequently, the lateral area of the metal conductor piece per unit length is larger than that of the linear element per unit area.

A dielectric may be inserted between the metal conductor piece and one side of the cavity. In this case, the dielectric serves to increase the capacitance of the metal conductor piece. If the capacitance increases, the physical length of the linear element can be shortened further, and the mechanical strength between the metal conductor piece and the cavity can be increased.

DETAILED DESCRIPTION OF THE INVENTION

Embodiments of the present invention will now be described in detail with reference to the accompanying drawings.

(First Embodiment)

Figure 1A:
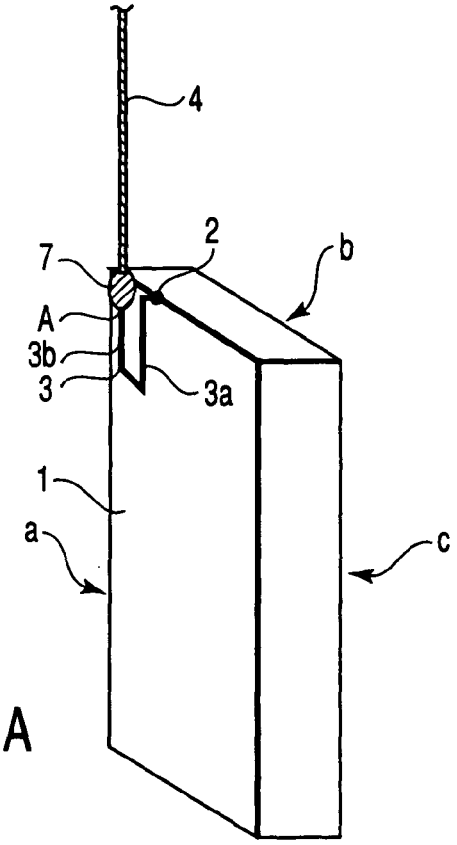
FIG. 1A is a perspective view of an antenna apparatus according to a first embodiment of the present invention.
Figure 1B:
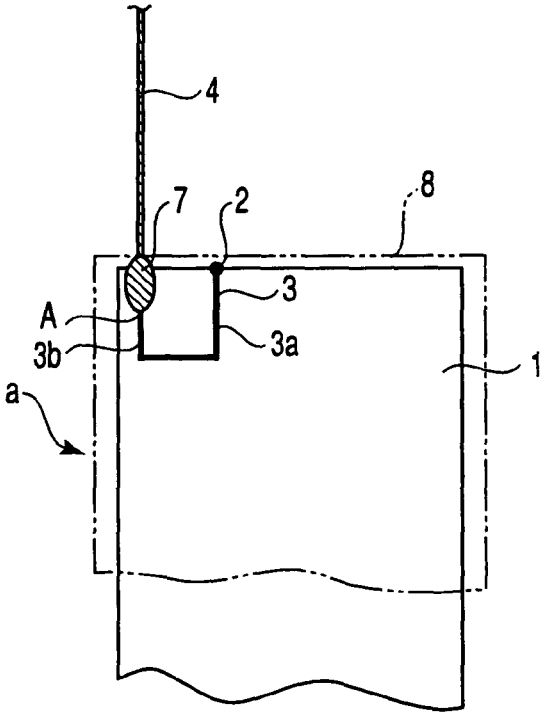
FIG. 1B is a front view of the antenna apparatus according to the first embodiment of the present invention.
Figure 1C:
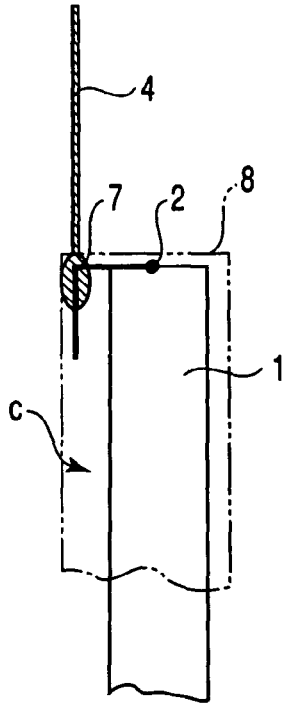
FIG. 1C is a side view of the antenna apparatus according to the first embodiment of the present invention.

FIGS. 1A to 1C are schematic diagrams of an antenna apparatus according to a first embodiment of the present invention. The antenna apparatus includes a cavity 1, a feeding point 2 arranged on the cavity 1, a linear element 3 extending from the feeding point 2 and having a physical length of shorter than a one-quarter wavelength, a half-wave antenna element 4 connected to the end of the linear element 3, and a metal conductor piece 7 including a connecting point 6 (see FIG. 2A) between the linear element 3 and the half-wave antenna element 4 and located close to one side of the cavity 1.

More specifically, the metal conductor piece 7 is provided within a face a of the cavity 1 and at a given distance from the face a.

The physical length of the linear element 3 is shorter than a one-quarter wavelength, whereas the electric length thereof is a one-quarter wavelength. The linear element 3 is therefore referred to as a λ/4 element hereinafter. In the present invention, the physical length of the λ/4 element 3 means the actual physical distance from the feeding point 2 to the connecting point 6.

As illustrated in FIG. 1B, the λ/4 element 3 includes a first portion 3*a* extending downward from the feeding point 2 in parallel with the face a of the cavity 1 or in a direction opposite to a direction in which the half-wave antenna element 4 extends and a second portion 3*b* extending upward in parallel with the face a or in the same direction as that in which the half-wave antenna element 4 extends. The λ/4 element 3 is thus bent downward from the feeding point to allow a reduction in leakage of current to the cavity 1.

The cavity 1 and the λ/4 element 3 serving as a matching circuit are finally encased in a plastic cavity 8 such as a cellular phone. The metal conductor piece 7 shortens the physical length of the λ/4 element 3 to make it easy to encase the element 3 in the cavity 8 and broaden an allowable frequency band of the antenna apparatus. This principle will be described below.

Figure 2A:
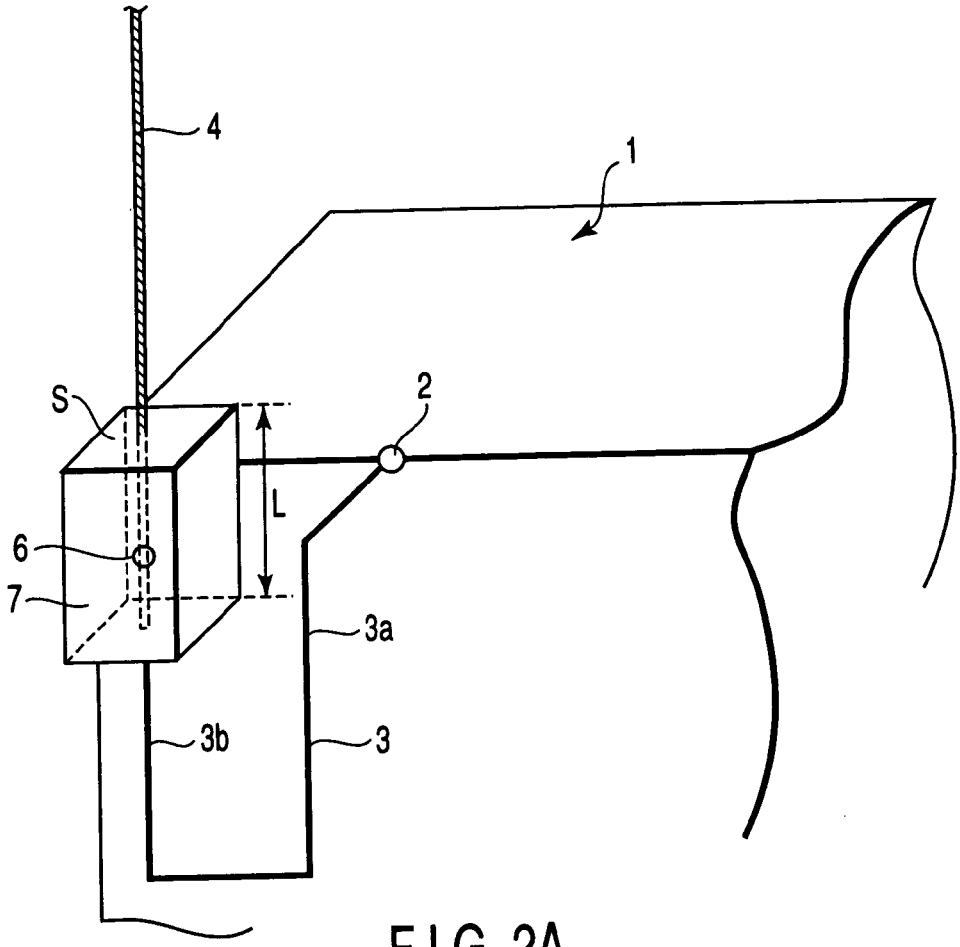
FIG. 2A is an enlarged perspective view of a square-pole metal conductor piece that is applied to the antenna apparatus shown in FIGS. 1A to 1C.
Figure 2B:
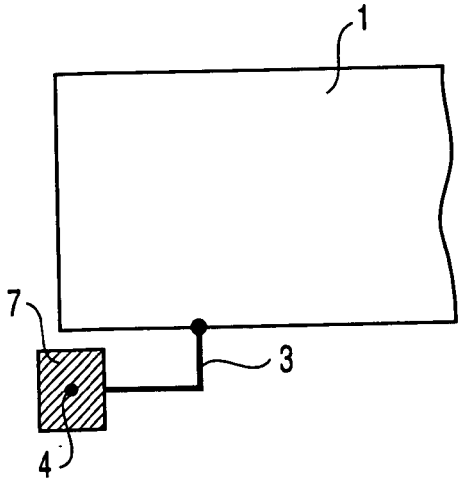
FIG. 2B is a top view of the apparatus shown in FIG. 2A.
Figure 2C:
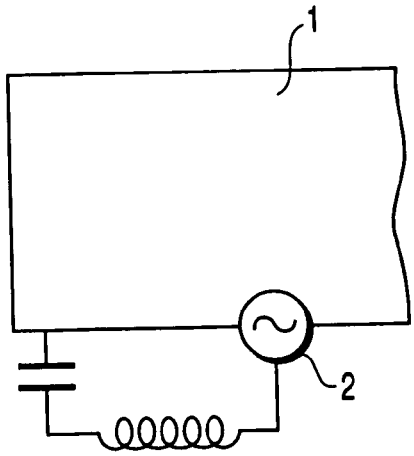
FIG. 2C is a lumped-constant equivalent circuit diagram of a λ/4 element of the antenna apparatus shown in FIG. 2B.

FIGS. 2A to 2C illustrate a rectangular parallelepiped as an example of the metal conductor piece 7. The end portion of the second portion 3*b* of the λ/4 element 3, which extends upward, is connected to the half-wave element 4 in the metal conductor piece 7. In FIG. 2A, the connecting point 6 is located in almost the central part of the metal conductor piece 7; however, the location is not limited to the central part if the connecting point 6 is provided inside the metal conductor piece 7.

FIG. 2C shows a lumped-constant equivalent circuit of the λ/4 element 3. Since the electric length of the element 3 is a one-quarter wavelength, its end portion (an end of the second portion 3*b*) becomes capacitive. The cross-sectional area S of the metal conductor piece 7 attached to the end portion of the λ/4 element 3 is larger than that of the λ/4 element 3. Since capacitance C increases in proportion to the cross-sectional area and in inverse proportion to the distance, the length (i.e., physical length) of the λ/4 element 3 extending from the feeding point 2 on the cavity 1 can be shortened by an amount of increase in cross-sectional area of metal conductor piece 7.

To shorten a linear element generally narrows an allowable frequency band of a matching circuit. In the first embodiment of the present application, however, the capacitive metal conductor piece 7 inhibits the matching circuit from decreasing in frequency band and serves to broaden the frequency band of the matching circuit. This is because the metal conductor piece is thicker than the λ/4 element 3 and current flows more flexibly, thereby producing a plurality of resonant states. The shape of the metal conductor piece 7 is not limited to the rectangular parallelepiped. Even though it is shaped like a plate, the frequency band of the λ/4 element 3 is broadened.

Figure 3A:
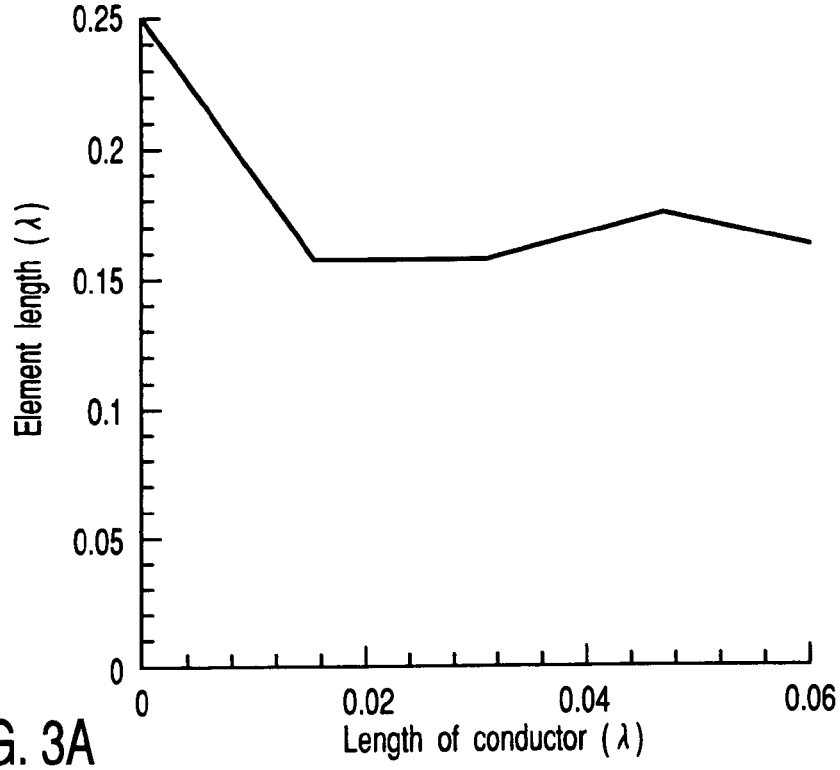
FIG. 3A is a graph representing a relationship between the length of the conductor and that of the element.
Figure 3B:
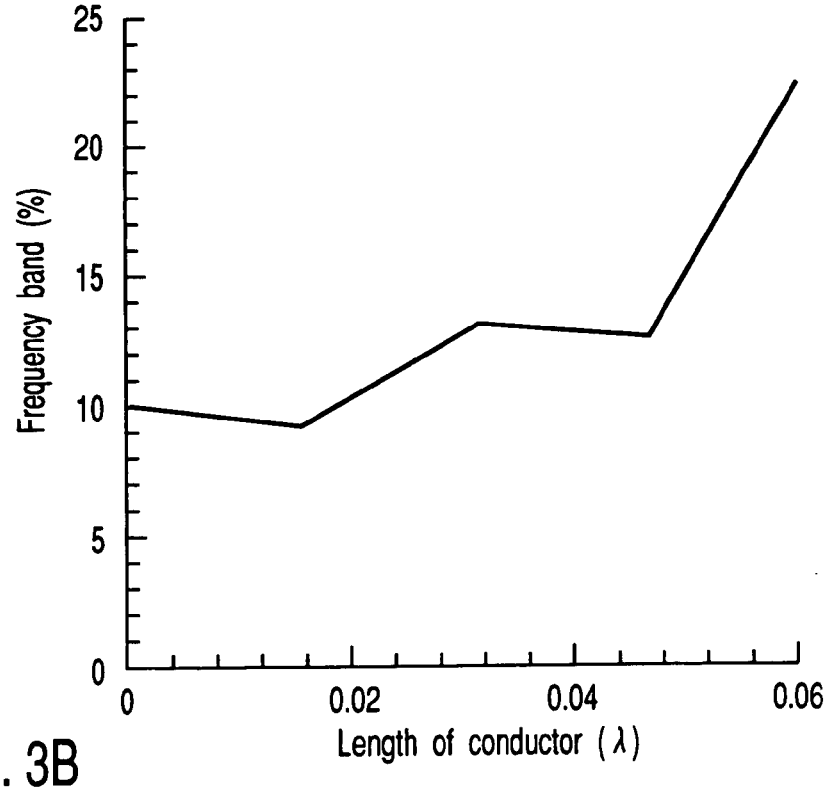
FIG. 3B is a graph representing a relationship between the length of the conductor and a frequency band.

FIGS. 3A and 3B are graphs showing an effect of shortening the λ/4 element 3 and a result of simulation for broadening a frequency band. In FIG. 3A, the horizontal axis represents the length of the metal conductor piece 7 denoted by L in FIG. 2A, while the vertical axis represents the physical length of the λ/4 element 3 (the length from the feeding point 2 to the connecting point 6 in within the metal conductor piece 7).

The graph shown in FIG. 3A denotes the physical length of the λ/4 element 3 to accomplish a desired characteristics relating the electric length of λ/4 depending on the change of the length L.

Specifically, when the length L of the metal conductor piece 7 is shorter than 0.015λ, the physical length of the λ/4 element 3 decreases linearly from 0.25λ. When the length L exceeds 0.015λ, the physical length becomes almost constant in the neighborhood of 0.15λ. When the length L exceeds 0.03λ, the λ/4 element 3 starts to increase in length; however, when it exceeds about 0.04λ, the element 3 decreases in length again.

It is seen from the above simulation result that the length of the λ/4 element 3 can be shortened to about one-sixth wavelength. Considering a commonly-used frequency that is within a rage of 0.8 to 2 GHz, the conventional λ/4 element required a length ranging from 4 cm to 9 cm, whereas the length of the λ/4 element 3 has only to fall within a range of 2.7 cm to 6 cm.

In FIG. 3B, the horizontal axis represents the length L of the metal conductor piece 7, and the vertical axis represents the frequency band (%) of the λ/4 element 3. When the length L exceeds 0.015λ, the frequency band starts to increase. When the length L exceeds 0.045λ, the frequency band increases abruptly.

Considering the size and weight of the entire antenna apparatus, it is not desirable that the length L of the metal conductor piece 7 increase too greatly, but desirable that the operating frequency band of the element 3 be broadened. To strike a balance between them, it is desirable that the length L of the metal conductor piece 7 range from 0.05λ to 0.06 λ.

FIGS. 4A to 4E each illustrate an example of the shape of the metal conductor piece 7. The metal conductor piece 7 can be formed like a cylinder, a square pole, a sphere, a plate, a hollow cylinder, or the like. The hollow-cylinder metal conductor piece 7 shown in FIG. 4E can be lightened and so can be the entire antenna apparatus. In the hollow-cylinder metal conductor piece 7, the half-wave antenna element 4 can be encased in a plastic cavity through a hollow of the metal conductor piece 7.

If the cross-sectional area of the metal conductor piece 7 is larger than that of the λ/4 element 3, the element 3 can be shortened. Therefore, the shape of the metal conductor piece 7 is not limited to the examples shown in FIGS. 4A to 4E. The way in which current flows on the metal conductor piece 7 is diversified and thus an advantage of increasing the frequency band can be obtained. The metal conductor piece 7 can thus be formed into an arbitrary shape if the lateral area of the metal conductor piece 7 per unit length is larger than that of the λ/4 element 3 per unit length. Since, moreover, a variety of current paths have only to be formed, only the surface of the metal conductor piece 7 can be formed of a conductor and the inside thereof can be formed of a light insulator.

The metal conductor piece can be formed of aluminum, copper, brass, or the like.

According to the first embodiment of the present invention, the metal conductor piece 7 contributes two advantages. The one is the reducible mounting area by shortening the physical length of the λ/4 element 3. The other is to broaden the frequency band of the matching circuit comprised by the λ/4 element 3.

(Second Embodiment)

Figure 5A:
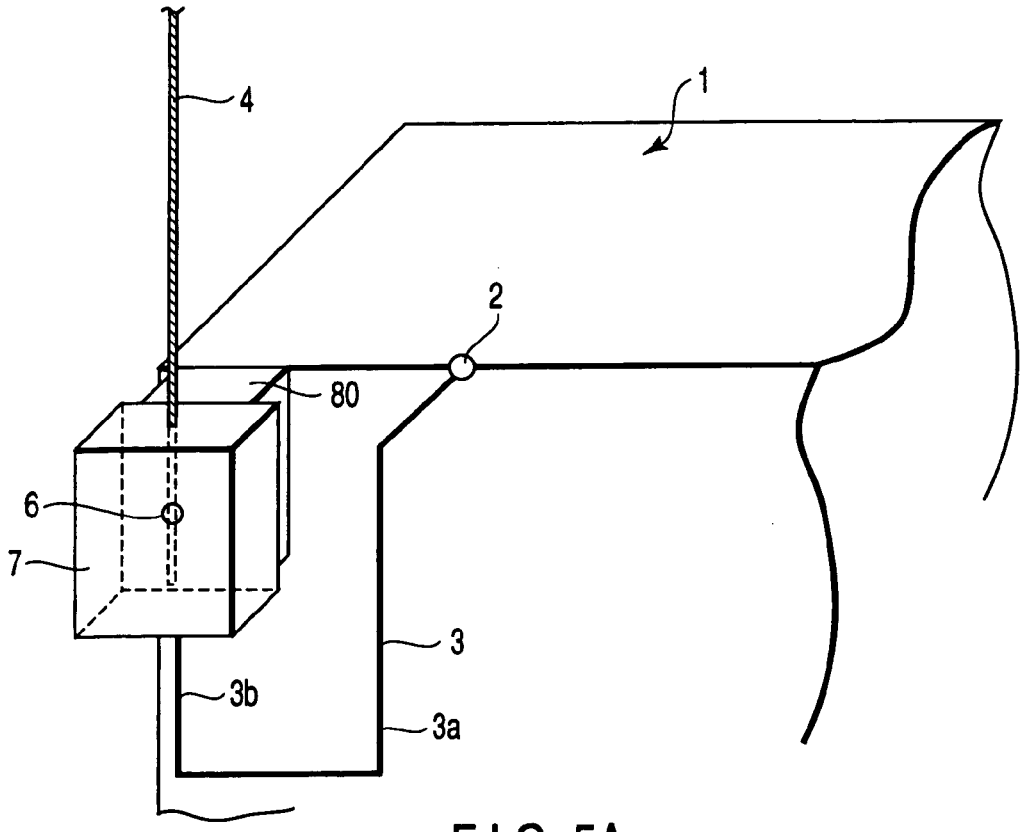
FIG. 5A is a perspective view of an antenna apparatus according to a second embodiment of the present invention.
Figure 5B:
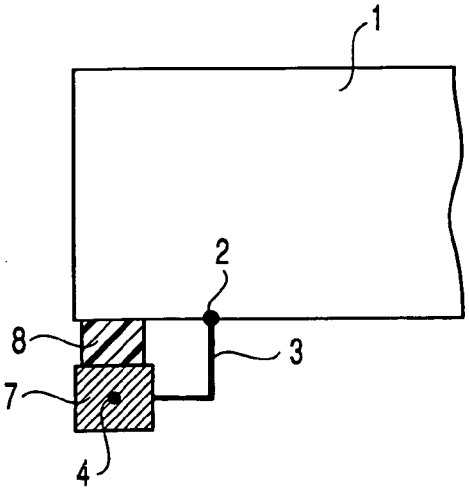
FIG. 5B is a front view of the antenna apparatus according to the second embodiment of the present invention.
Figure 5C:
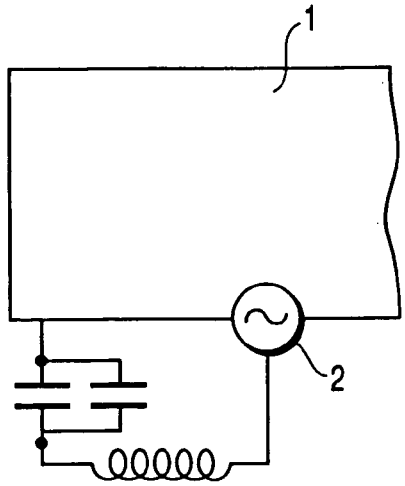
FIG. 5C is a side view of the antenna apparatus according to the second embodiment of the present invention.

FIGS. 5A to 5C are views of an antenna apparatus according to a second embodiment of the present invention. In the second embodiment, a dielectric 80 is inserted between a metal conductor piece 7 and a cavity 1. As shown in the equivalent circuit diagram of FIG. 5C, the dielectric 80 is connected in parallel with the metal conductor piece 7 and serves to increase the capacitance between the cavity 1 and the metal conductor piece 7. If the capacitance is increased, the length of a λ/4 element 3, which is in inverse proportion to the capacitance, can be decreased further.

Figure 4A:
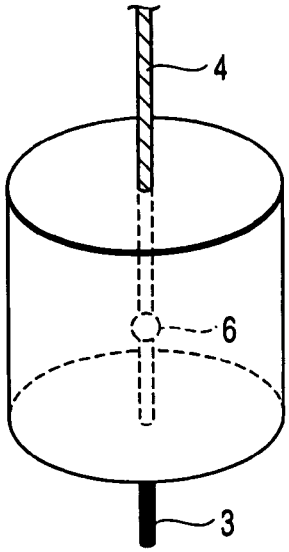
FIG. 4A is a view of a cylindrical metal conductor piece used in the antenna apparatus shown in FIGS. 1A to 1C.
Figure 4B:
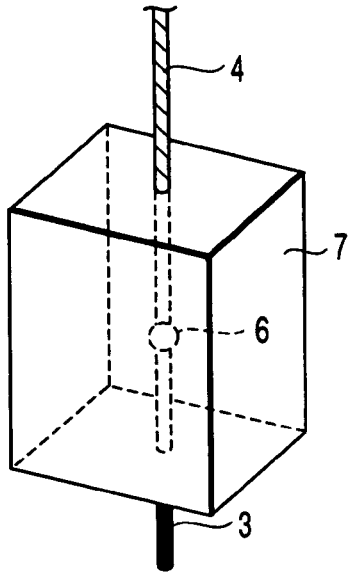
FIG. 4B is a view of a square-pole metal conductor piece used in the antenna apparatus shown in FIGS. 1A to 1C.
Figure 4C:
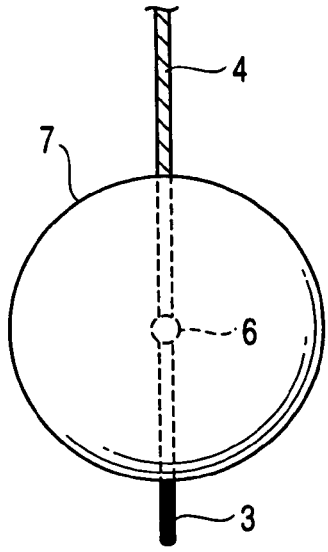
FIG. 4C is a view of a spherical metal conductor piece used in the antenna apparatus shown in FIGS. 1A to 1C.
Figure 4D:
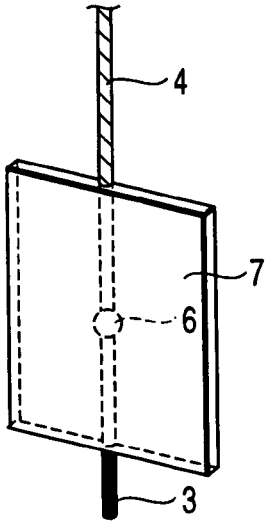
FIG. 4D is a view of a plate-like metal conductor piece used in the antenna apparatus shown in FIGS. 1A to 1C.
Figure 4E:
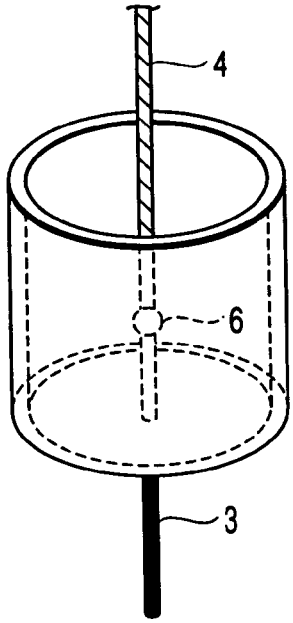
FIG. 4E is a view of a hollow-cylinder metal conductor piece used in the antenna apparatus shown in FIGS. 1A to 1C.

If, moreover, the dielectric 80 is inserted between the metal conductor piece 7 and the cavity 1, a physical connection between the metal conductor piece 7 and cavity 1 can be secured to protect the antenna apparatus from a shock or the like. In the example of FIGS. 5A to 5C, the metal conductor piece 7 and dielectric 80 are both square poles; however, they can be formed like a plate as shown in FIG. 4D in consideration of their insertion into the plastic cavity.

The dielectric 80 can be formed of plastic, FRP (fiber reinforced plastics) or the like.

In the second embodiment, the λ/4 element 3 can be shortened more effectively and a variety of current paths can be formed on the metal conductor piece 7 to broaden the operating band of the element. Furthermore, the mechanical strength of the antenna apparatus can be enhanced. As in the first embodiment, the λ/4 element 3 includes a first portion 3*a* extending downward from a feeding point (in a direction opposite to a direction in which a half-wave antenna element 4 extends) and a second portion 3*b* extending in the same direction as that of the antenna element 4 from a short portion of the first portion 3*a*, thus preventing current from leaking to the cavity 1.

The present invention is not limited to the above embodiments, but various modifications can be made. In the first and second embodiments, the λ/4 element 3 includes the first portion 3*a* extending downward and the second portion 3*b* extending upward, which are bent at right angles. However, the first and second portions 3*a* and 3*b* need not be bent at right angles but can be bent like a letter "U" based on the premise that a connecting point between the λ/4 element 3 and the half-wave antenna element 4 is located below the feeding point 2.

Figure 6A:
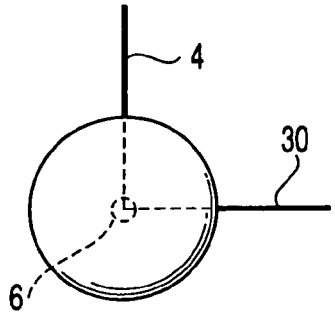
FIG. 6A is a perspective view of a spherical metal conductor piece in which a λ/4 element and λ/2 element cross at right angles.
Figure 6B:
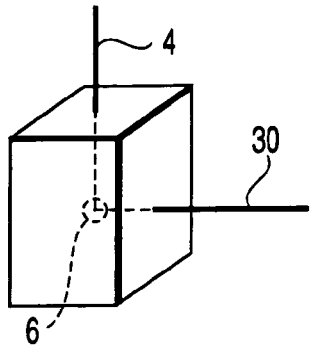
FIG. 6B is a perspective view of a square-pole metal conductor piece in which a λ/4 element and λ/2 element cross at right angles.
Figure 6C:
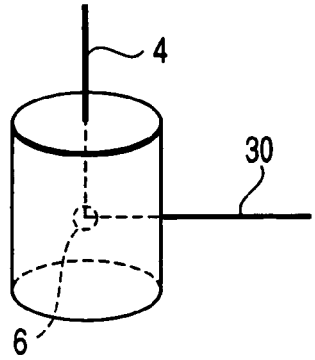
FIG. 6C is a perspective view of a cylindrical metal conductor piece in which a λ/4 element and λ/2 element cross at right angles.
Figure 7:
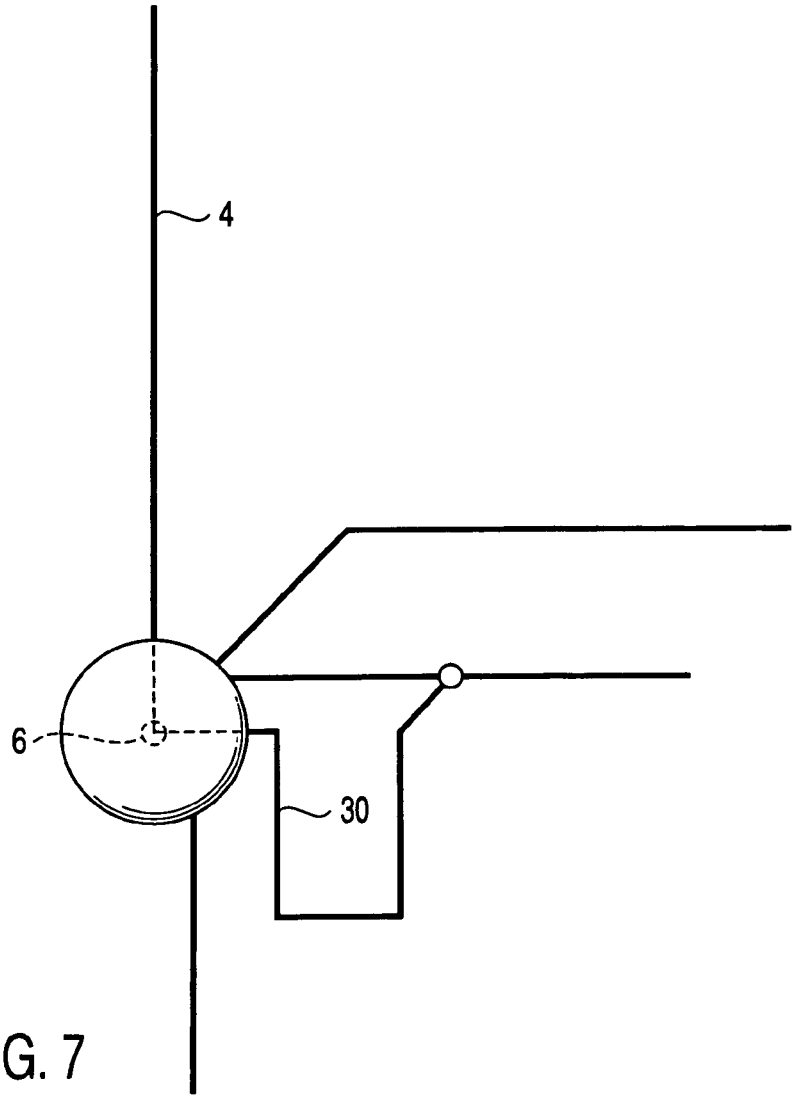
FIG. 7 is an enlarged perspective view of a spherical metal conductor piece shown in FIG. 6A, which is applied to an antenna apparatus according to another embodiment of the present invention.
Figure 8:
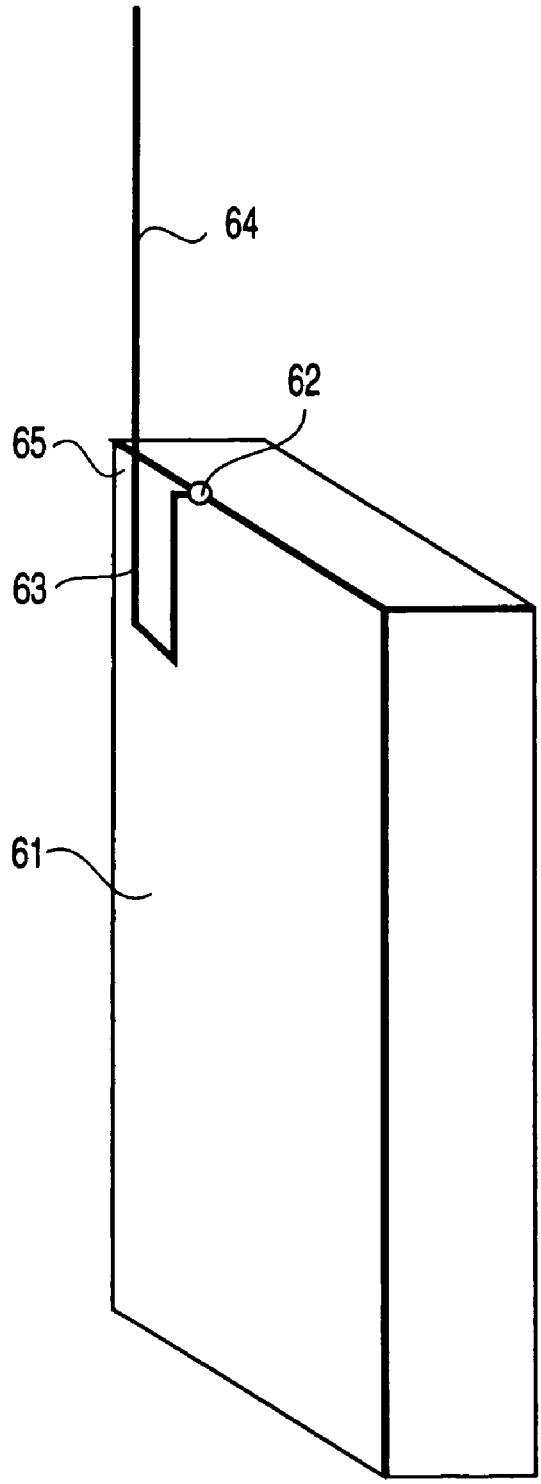
FIG. 8 PRIOR ART
FIG. 8 is a schematic perspective view of a prior art antenna apparatus.

Although, it was depicted (e.g. in FIG. 2) that the second portion 3*b* of the λ/4 element 3 is aligned with the half-wave antenna element 4, the λ/4 element and the half-wave antenna element may cross at right angles as depicted in FIGS. 6A to 6C. In such a connection example depicted in FIG. 6A, the λ/4 element 30 is connected to the half-wave antenna element 4 at the point 6 in a spherical metal conductor piece. In another connection example depicted in FIG. 6B, the λ/4 element 30 is connected to the half-wave antenna element 4 at the point 6 in a square-pole metal conductor piece. In still another connection example depicted in FIG. 6C, the λ/4 element 30 is connected to the half-wave antenna element 4 at the point 6 in a cylindrical metal conductor piece. FIG. 7 is an enlarged perspective view of a spherical metal conductor piece shown in FIG. 6A, which is applied to an antenna apparatus according to another embodiment of the present invention.

As described above, according to the antenna apparatus of the present invention, the physical length of the λ/4 element can be shortened and the operating frequency band of the element can be broadened. Thus, compatibility between a reduction in mounting area and an increase in frequency band can be achieved. Moreover, the mechanical strength of the antenna apparatus can be enhanced.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An antenna apparatus, comprising:

a cavity having a cavity surface with an end portion;

a feeding point arranged at the end portion of the cavity surface;

a $\lambda/4$ linear element having a first end connected to the feeding point, and a second end separated from the first end by a physical length shorter than a one-fifth wavelength; and a half-wave antenna element connected to the second end of the $\lambda/4$ linear element at a connecting point via a conductor piece having a conductor piece surface arranged separate from the cavity surface, the conductor piece having a length greater than $0.03\lambda$.

2. The antenna apparatus according to claim 1, wherein the linear element includes a first portion extending in a first direction opposite to that of the half-wave element from the feeding point and a second portion extending in a second direction, which is equal to a direction in which the half-wave antenna element extends.

3. The antenna apparatus according to claim 2, wherein the connecting point is located within a predetermined distance of the feeding point.

4. The antenna apparatus according to claim 1, wherein the physical length of the linear element ranges from a one-sixth wavelength to a one-fifth wavelength.

5. The antenna apparatus according to claim 1, wherein the linear element is aligned with the half-wave element inside the conductor piece.

6. The antenna apparatus according to claim 1, wherein a cross-section al area of the conductor piece is larger than that of the linear element.

7. The antenna apparatus according to claim 1, wherein a lateral area of the conductor piece per unit length is larger than that of the linear element per unit area.

8. The antenna apparatus according to claim 1, wherein the conductor piece is spherical.

9. The antenna apparatus according to claim 1, wherein the conductor piece is shaped like a square-pole.

10. The antenna apparatus according to claim 1, wherein the conductor piece is cylindrical.

11. The antenna apparatus according to claim 1, wherein the conductor piece comprises an internal dielectric coated with the conductor surface.

12. The antenna apparatus according to claim 1, further comprising a dielectric inserted between the conductor piece and the cavity.

13. An antenna apparatus, comprising:

a cavity having a cavity surface with an end portion;

a feeding point arranged at the end portion of the cavity surface;

a linear element having a first end connected to the feeding point, and a second end separated from the first end by a physical length shorter than a one-fifth wavelength, and being arranged so as not to be electrically connected to said cavity; and a half-wave antenna element connected to the second end of the linear element at a connecting point via a conductor piece having a conductor piece surface arranged separate from the cavity surface, the conductor piece having a length greater than $0.03\lambda$.

14. An antenna apparatus, comprising:

a cavity having a cavity surface with an end portion;

a feeding point arranged at the end portion of the cavity surface;

a linear element having a first end connected to the feeding point and a second end separated from the first end by a physical length shorter than a one-fifth wavelength, and being arranged so as to be electrically separated from said cavity and a half-wave antenna element connected to the second end of the linear element at a connecting point via a conductor piece having a conductor piece surface arranged separated from the cavity surface, the conductor piece having a length greater than $0.03\lambda$.

15. An antenna apparatus, comprising:

a cavity having a cavity surface with an end portion;

a feeding point having a ground terminal which is connected to the cavity surface and arranged at the end portion of the cavity surface;

a linear element having a first end connected to the feeding point, and a second end separated from the first end by a physical length shorter than a one-fifth wavelength; and a half-wave antenna element connected to the second end of the linear element at a connecting point via a conductor piece having a conductor piece surface arranged separate from the cavity surface, the conductor piece having a length greater than $0.03\lambda$.

* * * * *